US006216376B1

(12) United States Patent
Alvern

(10) Patent No.: US 6,216,376 B1
(45) Date of Patent: Apr. 17, 2001

(54) DISPLAY APPARATUS

(75) Inventor: Øyvind Alvern, Hjellestad (NO)

(73) Assignee: Alvern ASA, Houston, TX (US)

( * ) Notice: Subject to any disclaimer, the term of this patent is extended or adjusted under 35 U.S.C. 154(b) by 0 days.

(21) Appl. No.: 08/718,740

(22) Filed: Sep. 18, 1996

(51) Int. Cl.[7] ..... G09F 03/00
(52) U.S. Cl. ..... 40/642.01; 40/611
(58) Field of Search ..... 40/299.01, 661, 40/609, 611, 642.01; 248/683; 222/23; 141/98, 206, 392

(56) References Cited

U.S. PATENT DOCUMENTS

| | | | |
|---|---|---|---|
| D. 173,006 | 9/1954 | Anderson . | |
| D. 173,007 | 9/1954 | Anderson . | |
| D. 279,483 | 7/1985 | Goldman . | |
| D. 279,484 | 7/1985 | Goldman . | |
| D. 366,310 | 1/1996 | Fell . | |
| 3,739,988 | 6/1973 | Kisor et al. | 239/288 |
| 4,408,791 | 10/1983 | Griffin et al. . | |
| 4,465,209 | 8/1984 | Wilder . | |
| 4,690,182 | 9/1987 | Knaus . | |
| 5,058,637 | 10/1991 | Fell | 40/661 X |
| 5,184,309 | 2/1993 | Simpson et al. . | |
| 5,184,655 | 2/1993 | Fell | 40/661 X |

FOREIGN PATENT DOCUMENTS

| | | |
|---|---|---|
| 122642 | 2/1995 | (AU) . |
| 123343 | 5/1995 | (AU) . |
| 0407271A1 | 1/1991 | (EP) . |
| 2266759A | 6/1973 | (GB) . |
| 1393062 | 5/1975 | (GB) . |
| 2147273A | 5/1985 | (GB) . |
| 1244517A | 11/1993 | (GB) . |
| 62-208396 | 9/1987 | (JP) . |
| 850627 | 10/1992 | (JP) . |
| M 406/1996 | 1/1996 | (SE) . |
| WO 90/08375 | 7/1990 | (WO) . |
| WO 9315493A1 | 8/1993 | (WO) . |
| WO 9727141 | 7/1997 | (WO) . |

*Primary Examiner*—Joanne Silbermann
(74) *Attorney, Agent, or Firm*—Finnegan Henderson Farabow Garrett & Dunner, L.L.P.

(57) ABSTRACT

A display apparatus including a display carrying body removalby attachable to a fluid filler gun to cover an upper part of the gun head, where a display message card support is provided on the upper face of the display carrying body. The carrying body to the filler gun, by an interlocking attaching system where the first engaging part, located on the said display carrying body and configured to engage with the second engaging part, located on the filler gun head housing.

15 Claims, 7 Drawing Sheets

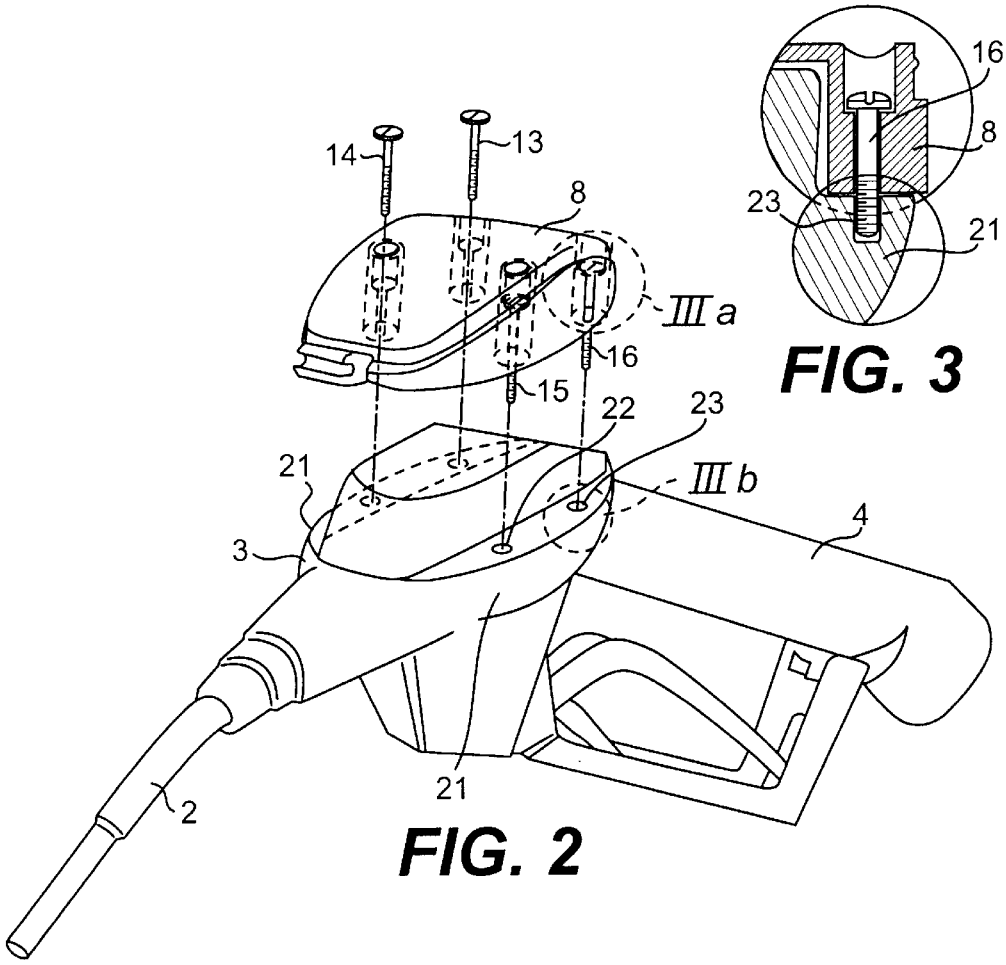
FIG. 2
FIG. 3
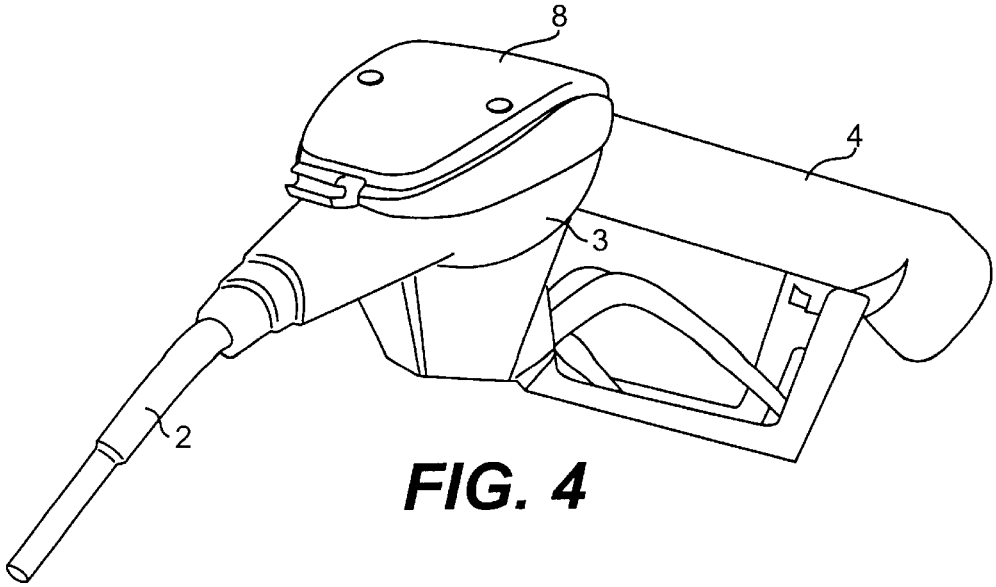
FIG. 4

DISPLAY APPARATUS

The present invention relates to a display apparatus with a display carrying body releasably attachable to a filler gun of a type including in sequence a gun barrel, a gun head with a housing, and a gun handle, the gun barrel joining the gun head at a first junction, and the gun handle joining the gun head at a second junction.

Although the present invention is in particular useful for use on a fuel pump filler gun, the invention is not limited thereto, but could be used on any fluid filler gun.

Various types of display apparatus with a display carrying body are known in the art, e.g. from U.S. patent application Ser. Nos. 08/284427, 08/590407 and 08/610961. Other relevant art is known from U.S. Pat. No. 5,058,637, EP patent 0407271, and British patents 2147273 and 1393062.

Various means have been suggested in the prior art for attaching a display carrying body to a fuel pump filler gun, such means including straps, an attachment body engageable with the display carrying body in order to encompass the gun head of the filler gun, as well as using a filler gun boot on which can be located a small sized display holder through the means of adhesive, rivets or the like.

The present invention aims at providing a structurally simpler display apparatus whereby said display carrying body is adapted, when fitted onto the filler gun, to cover an upper part of the gun head, a display message card support being provided on an upper face of the display carrying body, and means provided for releasably attaching the carrying body to the filler gun, said attaching means comprising first engagement means located on the display carrying body and configured to engage with second engagement means forming an integral part of said gun head housing. This means that the body of the gun head housing has such second engagement means, suitably formed through an integral casting operation of the gun head housing.

According to the invention, the first engagement means are screws and the second engagement means are screw receiving holes in said housing. Said second engagement means are suitably formed as lugs protruding from side faces of said housing and so configured as to engage with said first engagement means. Said lugs are suitably provided with threaded holes and said first engagement means are screws.

In an alternative embodiment, said screws extend through said upper face of the carrying body to engage holes provided in said upper part. In another embodiment, it is possible to let said screws extend through side regions of said carrying body and into said holes provided in side faces of the gun head housing.

In another embodiment, said first engagement means are suitably snap hook means, and said second engagement means are holes in said gun head housing for receiving and snap engaging with said snap hook means. Said snap hook means may e.g. depend from a lower side rim of the display carrying body or depend from a bottom face of the display card support.

According to still a further alternative of the present display apparatus, said first engagement means is located along a distance of a lower periphery of the display carrying body and formed as a male snap means, and said second engagement means is located along a distance of a peripheral region of said gun head housing and formed as a female snap means.

According to further features of the present invention a display message card is locatable on said upper face, and a display message card holder is attachable to said display carrying body. Further, said display carrying body suitably extends from adjacent said first junction to adjacent said second junction.

The invention is now to be further described with reference to the attached drawings showing typical examples of the present invention, however, without necessarily limiting the scope thereof.

FIGS. 2–4 illustrate a second embodiment of the display apparatus, according to the invention and being a slight modification of the embodiment in FIG. 1.

Figure 1:
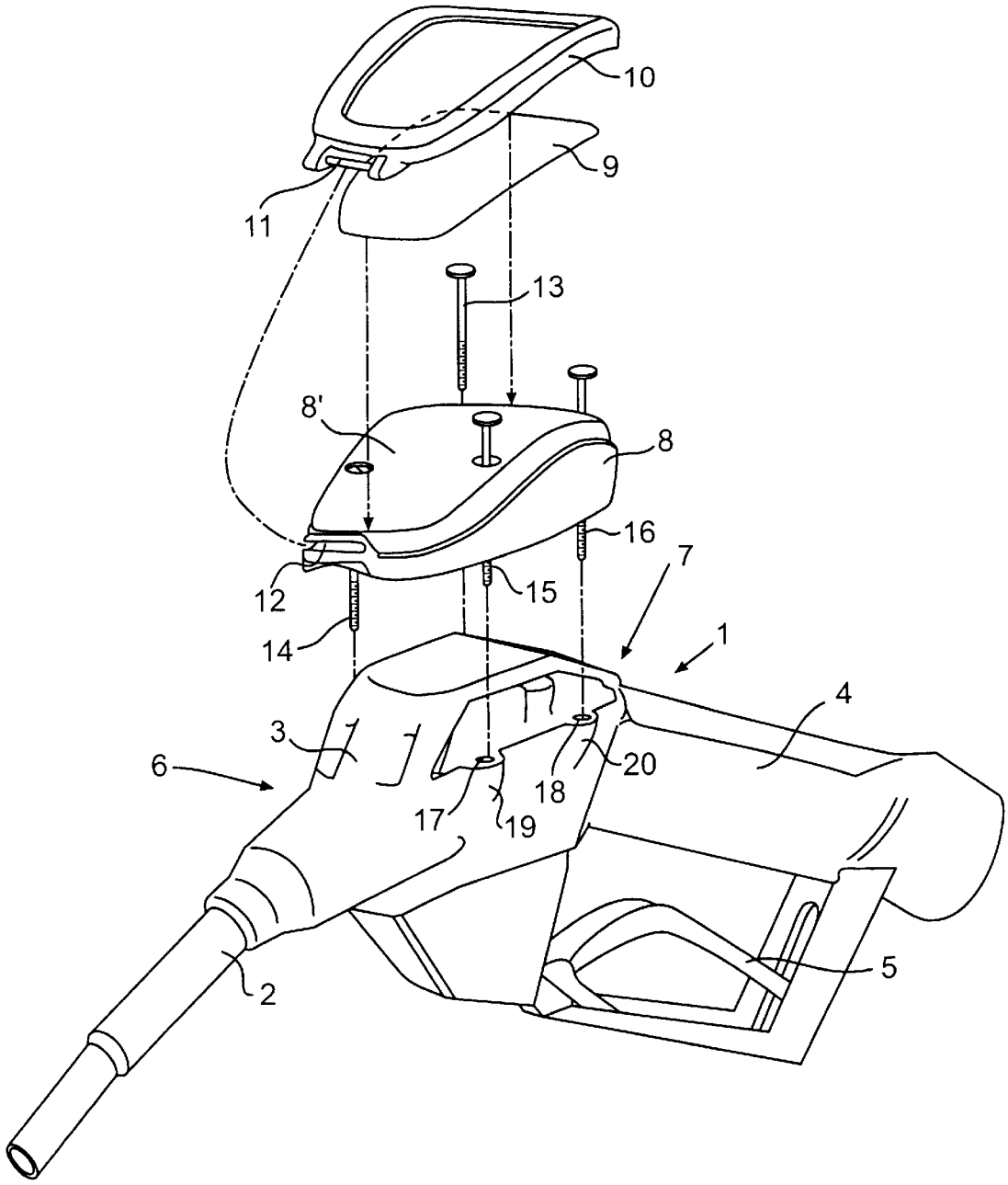
FIG. 1 shows a first embodiment of the display apparatus.

FIG. 1 shows a fluid filler gun 1, e.g. a fuel pump filler gun, having in sequence a gun barrel 2, a gun head 3 with a housing, and a gun handle 4. The gun handle 4 conventionally has operating lever 5 coacting with valve means (not shown) inside the housing of said gun head 3. The gun barrel 2 joins the gun head 3 at a first junction 6. The gun handle 4 joins the gun head 3 at a second junction 7. As clearly seen from FIG. 1, there is a display carrying body 8 which is removably attachable to the filler gun 1 and adapted to be fitted onto the filler gun 1 to cover an upper part of the gun head 3. A display message card 9 can be placed on an upper face 8' of said display carrying body. Further, a display message card holder 10 suitably formed as a frame, as indicated on FIG. 1 or a transparent lid has male hinge means 11 engageable with female hinge means 12 on said display carrying body 8. In order to releasably attach the carrying body 8 to the gun head 3 of the filler gun 1, there is provided first engagement means in the form of screws 13, 14, 16 extending through the upper face of the carrying body 8 and being engageable with second engagement means forming an integral part of the housing of said gun head 3. Said second engagement means are, in the embodiment of FIG. 1, screw receiving holes (of which only two are shown) 17, 18. Suitably the second engagement means are lugs which protrude from side faces of the gun head housing 3, said lugs suitably being provided with said threaded holes 17, 20.

In FIG. 2 a variant of the embodiment in FIG. 1 is shown. Instead of providing said lugs 19, 20, the housing of the gun head 3 has on either side thereof a second, widened portion 21 in which holes 22, 23 are located (only two of the four holes being shown on FIG. 2). FIG. 3 represents a combined cross section through the combined regions IIIa and IIIb. FIG. 4 shows the embodiment of FIG. 2 in assembled state.

Figure 5:
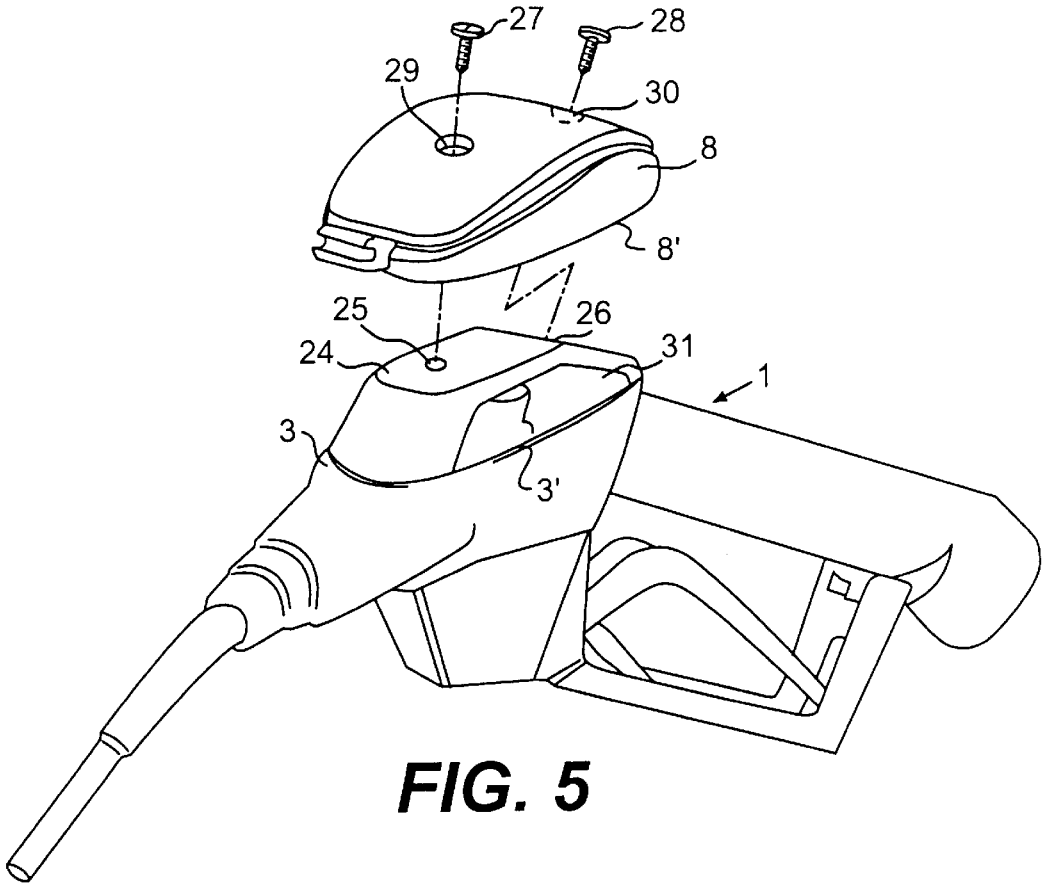
FIGS. 5 and 6 illustrate a third embodiment of the display apparatus according to the invention.
Figure 6:
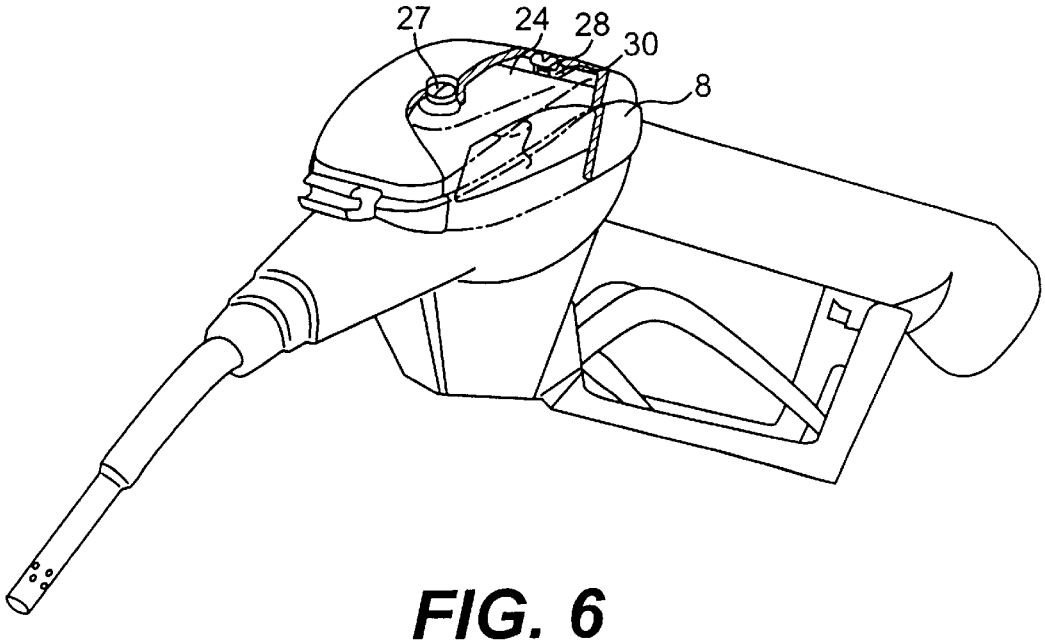

In FIG. 5 there is shown a filler gun 1 with a gun head 3 having an upper region 24 provided with holes 25, 26 for threaded engagement with screws 27, 28 extending through holes 29, 30 in the display carrying body 8. Thus, by proper dimensioning of the display carrying body 8, it would be possible to attach the body 8 to the gun head 3. Also, it is clearly seen from FIGS. 5 and 6 that the display carrying body 8 will cover any opening 31 in the upper part of the gun head 3. With properly designed lower rim 8' on the carrying body 8 and a corresponding abutment 3' on the gun head 3, the use of two screws 27, 28 only may be sufficient.

Figure 7:
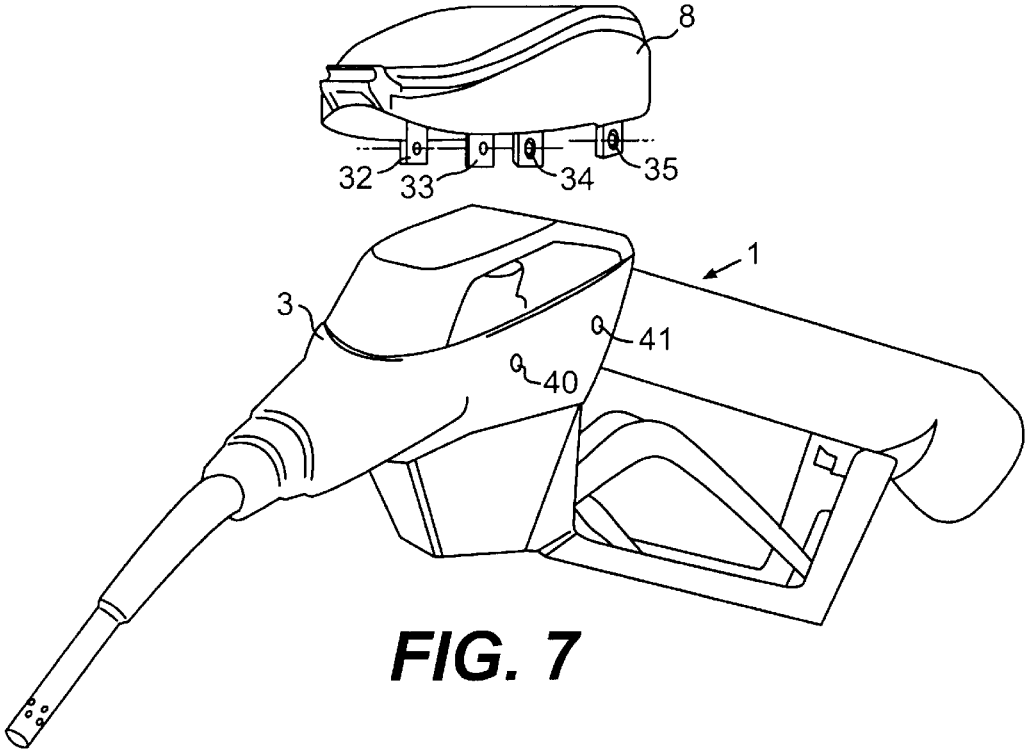
FIGS. 7 and 8 illustrate a fourth embodiment of the display apparatus according to the invention.
Figure 8:
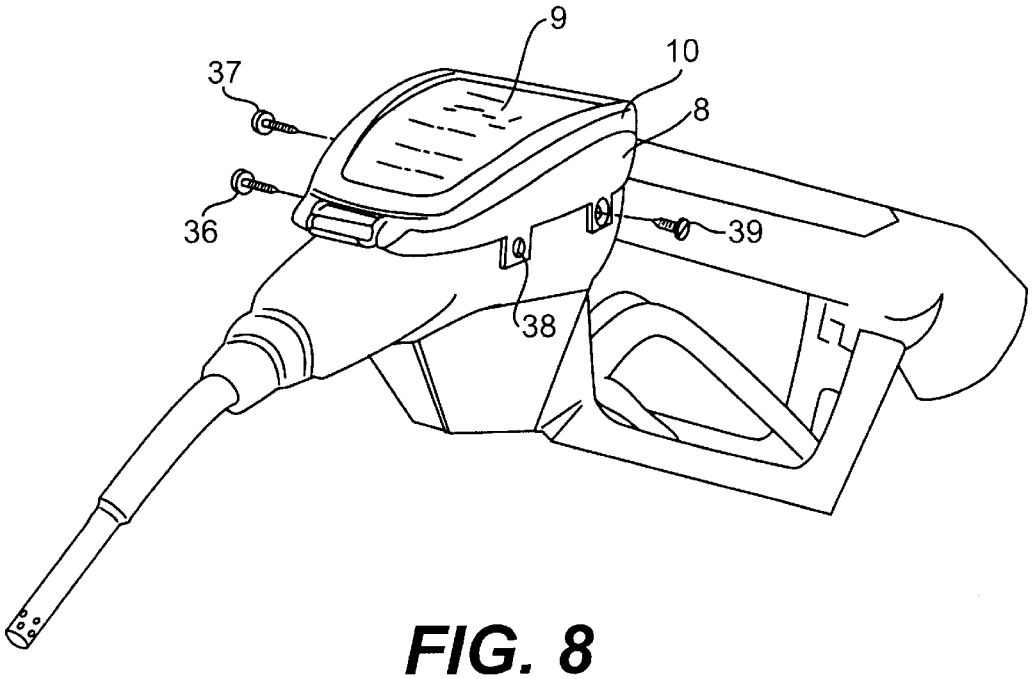

In another, third embodiment of the present invention, as shown on FIGS. 7 and 8, there are side regions 32, 33, 34, 35, suitably formed as depending lugs, on the carrying body, said side regions provided with holes through which screws 36, 37, 38 and 39, respectively, may extend and be screwed into holes 40, 41 (of which only two are shown) in the gun head housing in order to releasably attach the display carrying body 8 to the gun head 3.

Figure 9:
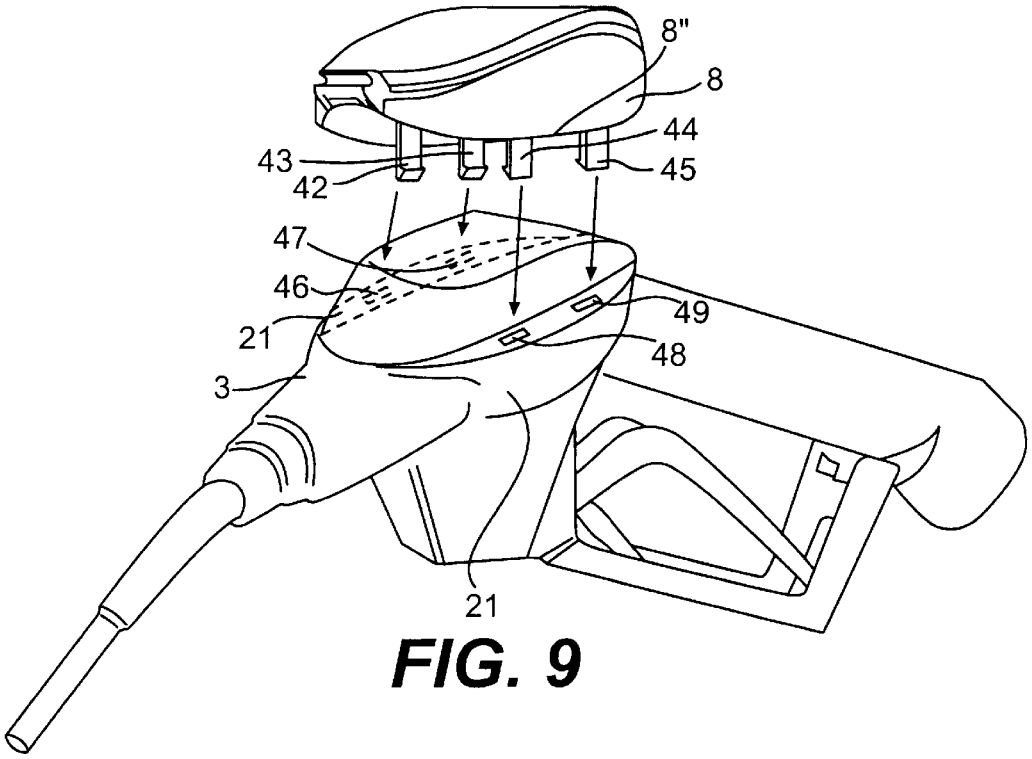
FIGS. 9–11 illustrate a fifth embodiment of the display apparatus according to the invention.
Figure 10:
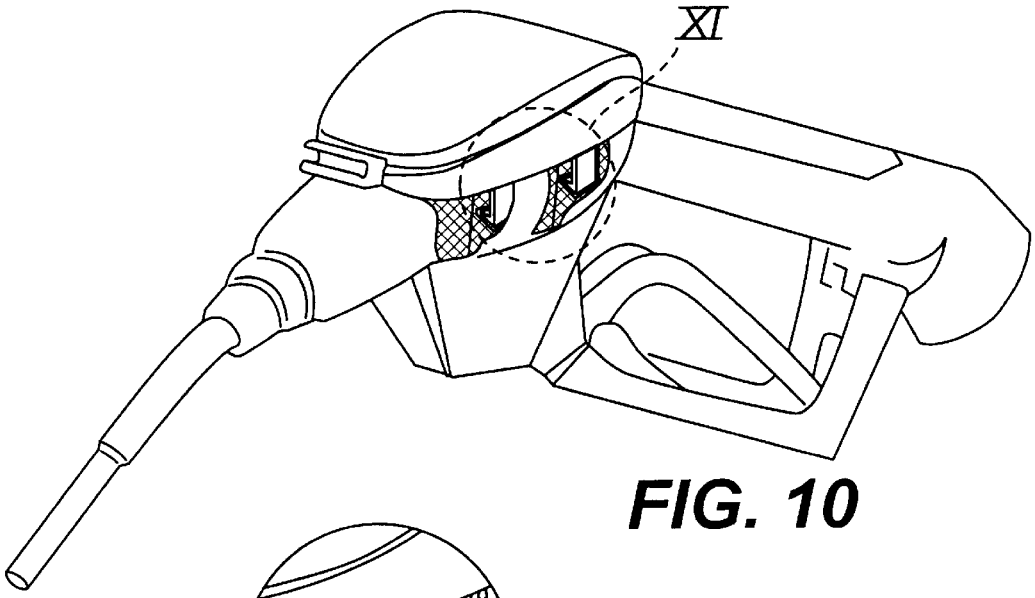
Figure 11:
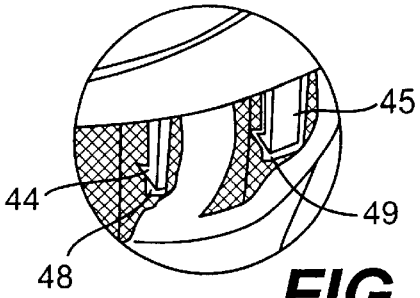

A further modification of the embodiment shown in FIGS. 2–4 appears now from FIGS. 9–11, FIG. 11 being an enlarged view of the region XI in FIG. 10. The first engagement means are here provided in the form of snap hooks 42, 43, 44 and 45 configured to fit into snap engagement holes 46, 47, 48 and 49, respectively, in the second, widened portions 21 on the housing of the gun head 3. The snap hooks 42–45 depend from a lower side rim 8" on the display carrying body 8. As shown in the enlarged view of FIG. 11, with parts of the housing of the gun head 3 broken away for sake of clarity, it is easily seen how e.g. the snap hooks 44, 45 may snap engage with a step provided in e.g. the holes 48, 49.

Figure 14:
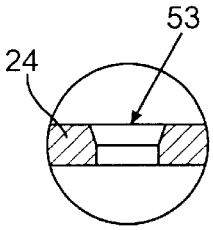
FIGS. 12–15 illustrate a sixth embodiment of the display apparatus according to the invention.
Figure 13:
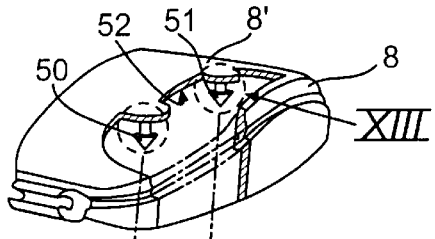
Figure 13:
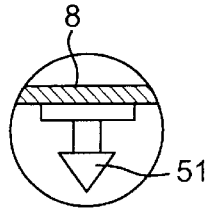
Figure 12:
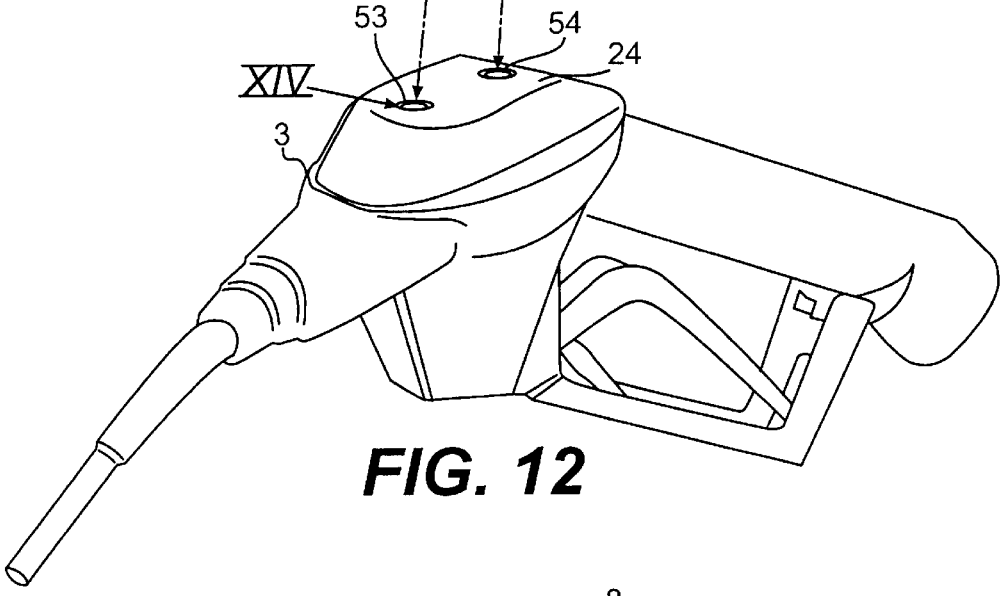
Figure 15:
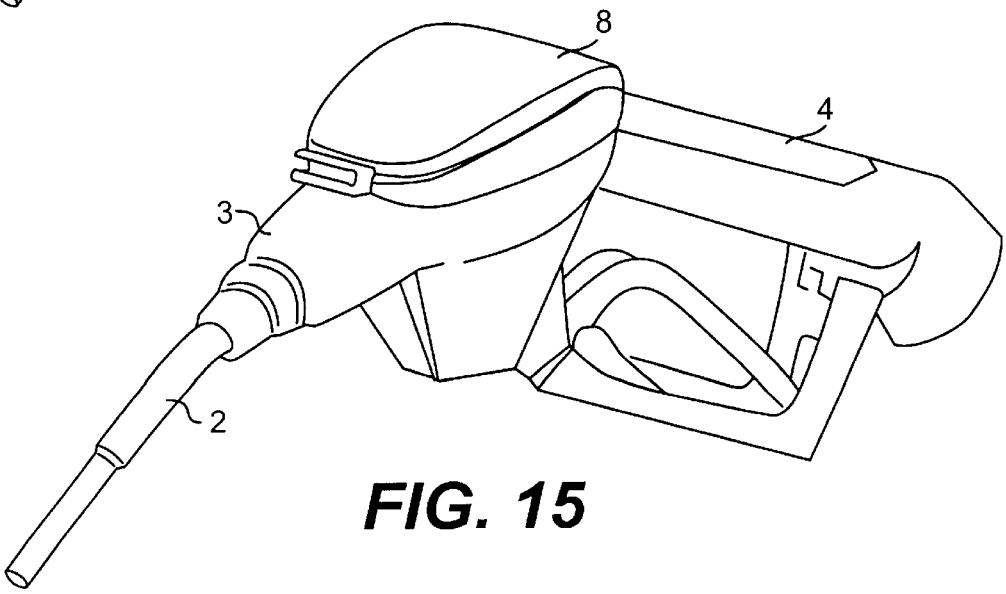

A further variant of the embodiment shown in FIG. 5 making use of snap engagement and being a sixth embodiment of the present invention, appears from FIGS. 12–15. FIG. 13 is an enlarged cross section at the location of the display carrying body 8 denoted by reference XIII in FIG. 12. FIG. 14 shows a cross section of the housing of the gun head 3 at the location indicated by XIV in FIG. 12. Thus, instead of the screws 27 and 28 as shown on FIG. 5 and 6, there are provided snap hooks 50, 51, e.g. formed with an arrow-like configuration as indicated more clearly in FIG. 13. Said snap hooks 50, 51 depend from a bottom face 52 of the carrying body 8, i.e. on the bottom face of the display card support 8'. The hooks 50, 51 engage with holes 53, 54 provided in the upper face 24 of the housing of the gun head 3.

Figure 17:
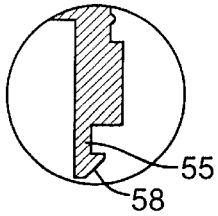
FIGS. 16–20 illustrate a seventh embodiment of the display apparatus according to the invention.
Figure 18:
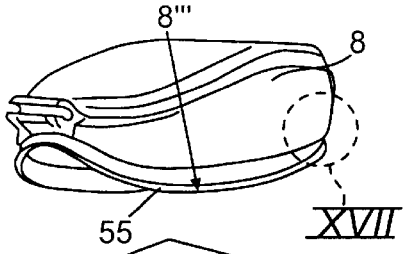
Figure 18:
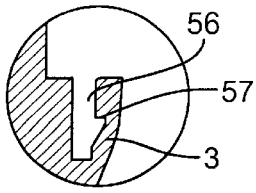
Figure 16:
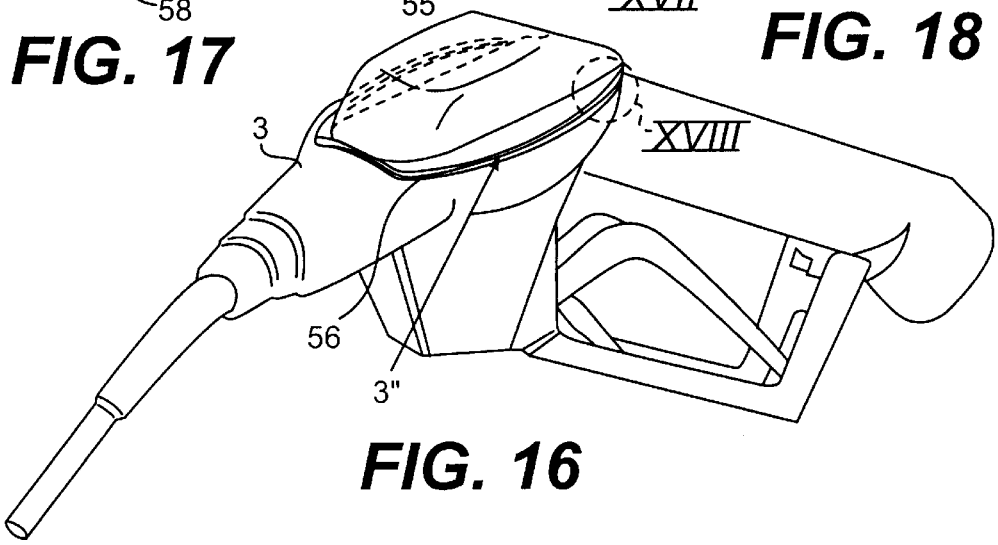

A seventh embodiment, according to the invention, appears from FIGS. 16–20. FIG. 17 is a cross section of the display carrying body 8 and is indicated by reference XVII in FIG. 16. FIG. 18 is a cross section on the housing of the gun head 3 at the location thereof indicated by reference XVIII in FIG. 16.

Figure 19:
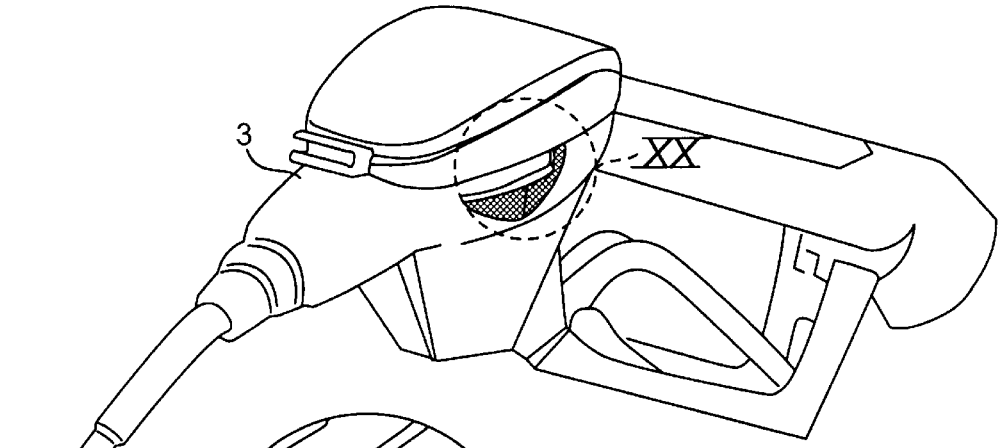
Figure 20:
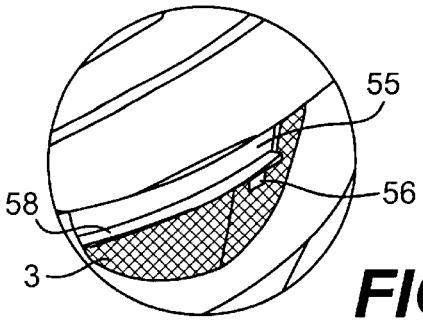

FIG. 20 is and enlarged view of the partly broken-away portion labelled XX in FIG. 19 of the gun head 3. As seen from the top of FIG. 16 the first engagement means is located along a distance of a lower periphery 8''' of the display carrying body 8, suitably along substantially the complete lower periphery and being formed as male snap means 55, as more closely seen from the cross section in FIG. 12. Said second engagement means is located along a distance of a peripheral region 3", suitably along most of the peripheral region of the gun head 3 and being formed as a female snap means 56 having a step 57 to engage with a step 58 on the male snap means 55 in order to obtain a snap engagement between the display carrying body 8 and the gun head 3. Thus, in the embodiment of FIGS. 16–20 there is no need for screw aided attachment of the display carrying body to the gun head 3.

It will be appreciated by the expert in the art that modifications of the embodiments as shown and described will be possible without departing from the inventive concept and features as defined in the attached patent claims.

What is claimed is:

1. A display apparatus comprising:

a fluid filler gun including a gun barrel, a gun head housing, and a gun handle, said gun head housing including an upper surface and side surfaces;

a display carrying body, releasably attachable to the fluid filler gun, said display carrying body being adapted, when fitted onto the filler gun, to substantially cover the upper surface of said gun head housing, said display carrying body having an upper face; and a male-type fastener located on said display carrying body configured to engage with a female-type fastener receiving portion located on said gun head housing, for releasably attaching said carrying body to the filler gun, wherein said display carrying body is further adapted to cover a portion of each side surface when fitted onto the filler gun.

2. A display apparatus according to claim 1, wherein said male-type fastener includes a screw and said female-type fastener receiving portion includes a screw receiving hole in said housing.

3. A display apparatus according to claim 2, wherein said screw extends through said upper face of the carrying body to engage with said hole provided in the upper part of said gun head housing.

4. A display apparatus according to claim 2, wherein said screw extends through a side region of said carrying body and into said hole provided in a side face of said gun head housing.

5. A display apparatus according to claim 1, wherein said fastener receiving portion includes a lug protruding from a side face of said housing and so configured as to engage with said fastener.

6. A display apparatus according to claim 5, wherein said lug is provided with a threaded hole and said fastener includes a screw.

7. A display apparatus according to claim 1, wherein said male-type fastener includes a snap hook and said female-type fastener receiving parts includes a hole in said gun head housing for receiving and snap engaging with said snap hook.

8. A display apparatus according to claim 7, wherein said snap hook depends from a lower side rim of the display carrying body.

9. A display apparatus according to claim 7, wherein said snap hook depends from a bottom face of a display card support.

10. A display apparatus according to claim 1, wherein said male type fastener is located along a lower periphery of the display carrying body and formed as a male snap portion, and said male-type fastener receiving portion is located along a peripheral region of said gun head housing and formed as a female snap portion.

11. A display apparatus according to claim 1, wherein a display message card is located on said upper face.

12. A display apparatus according to claim 1, wherein a display message card holder is attachable to said display carrying body.

13. A display apparatus according to claim 1, wherein said display carrying body extends from adjacent a first junction between said gun barrel and said gun head to adjacent a second junction between said gun head and said gun handle.

14. A display apparatus according to claim 1, wherein said male-type fastener is extendable through a first aperture defined in said upper face, and said male-type fastener receiving portion comprises a second aperture defined in an upper portion of said gun head housing.

15. A display apparatus according to claim 14, wherein said first aperture is defined proximate a side edge of said upper face, and said second aperture is defined proximate a side edge of said gun head housing.

* * * * *